US007511267B2

(12) United States Patent
Zabrouskov

(10) Patent No.: US 7,511,267 B2
(45) Date of Patent: Mar. 31, 2009

(54) DATA-DEPENDENT ACCURATE MASS NEUTRAL LOSS ANALYSIS

(75) Inventor: Vladimir Zabrouskov, Santa Clara, CA (US)

(73) Assignee: Thermo Finnigan LLC, San Jose, CA (US)

( * ) Notice: Subject to any disclaimer, the term of this patent is extended or adjusted under 35 U.S.C. 154(b) by 239 days.

(21) Appl. No.: 11/595,023

(22) Filed: Nov. 10, 2006

(65) Prior Publication Data

US 2008/0111068 A1 May 15, 2008

(51) Int. Cl.
*H01J 49/26* (2006.01)
*H01J 49/00* (2006.01)
*H01J 49/10* (2006.01)

(52) U.S. Cl. ..... 250/282; 250/281; 250/283; 702/27

(58) Field of Classification Search ..... 250/281, 250/282, 286, 287, 299, 283
See application file for complete search history.

(56) References Cited

U.S. PATENT DOCUMENTS 5,073,713 A * 12/1991 Smith et al. ..... 250/282
5,171,991 A * 12/1992 Johnson et al. ..... 250/292
6,504,148 B1 * 1/2003 Hager ..... 250/282
6,747,273 B2 * 6/2004 Brame et al. ..... 250/283
6,770,871 B1 * 8/2004 Wang et al. ..... 250/281
7,157,698 B2 * 1/2007 Makarov et al. ..... 250/281
7,196,324 B2 * 3/2007 Verentchikov ..... 250/287
7,476,854 B2 * 1/2009 Syage et al. ..... 250/293
2001/0052569 A1 12/2001 Bateman et al.
2002/0030159 A1 * 3/2002 Chernushevich et al. .... 250/287
2003/0082819 A1 * 5/2003 Brame et al. ..... 436/86
2003/0153007 A1 * 8/2003 Chen et al. ..... 435/7.1
2004/0026612 A1 * 2/2004 Bateman et al. ..... 250/281
2004/0031918 A1 2/2004 Schoen et al.
2004/0251409 A1 * 12/2004 Le Blanc ..... 250/288
2006/0009915 A1 1/2006 Goodlett
2006/0138320 A1 * 6/2006 Bateman ..... 250/288
2006/0255263 A1 * 11/2006 Ishimaru et al. ..... 250/288
2006/0284069 A1 * 12/2006 Le Blanc ..... 250/282
2007/0096021 A1 * 5/2007 LeBlanc et al. ..... 250/282

(Continued)

OTHER PUBLICATIONS

Beausoleil et al., "Large-scale Characterization of HeLA Cell Nuclear Phosphoproteins," Proceedings of the National Academy of Sciences, vol. 101 (33), http://www.pnas.org/cgi/doi/10.1073/pnas.0404720101, pp. 12130-12135, (2004).

(Continued)

*Primary Examiner*—Bernard E Souw
(74) *Attorney, Agent, or Firm*—Charles B. Katz

(57) ABSTRACT

A method is disclosed for data-dependent neutral loss analysis of biomolecules and other materials in a hybrid mass spectrometer. Candidate product ions are selected by identifying peaks in a MS/MS spectrum acquired in a first mass analyzer that exhibit a specified nominal neutral loss value, which may be representative of the mass of a peptide modification, such as phosphate. High mass accuracy MS and MS/MS spectra acquired at a second mass analyzer, such as an FTICR or Orbitrap, are processed to determine if the mass difference between a candidate product ion and its corresponding precursor matches an accurate neutral loss value. In one embodiment, $MS^3$ analysis is performed only on the candidate product ions that satisfy the accurate mass neutral loss value test.

13 Claims, 3 Drawing Sheets

U.S. PATENT DOCUMENTS

| | | | | |
|---|---|---|---|---|
| 2007/0254371 | A1* | 11/2007 | Kas et al. | 436/86 |
| 2008/0111066 | A1* | 5/2008 | Zhang et al. | 250/282 |
| 2008/0111068 | A1* | 5/2008 | Zabrouskov | 250/282 |
| 2008/0280317 | A1* | 11/2008 | Wu et al. | 435/23 |

OTHER PUBLICATIONS

Zhu, et al., "Detection and Characterization of Metabolites in Biological Matrices Using Mass Defect Filtering of Liquid Chromatography/High Resolution Mass Spectrometry Data," DMD Fast Forward, 51 pgs., (Jun. 30, 2006).

Hopfgartner, et al., "Rapid screening and characterization of drug metabolites using a new quadrupole-linear ion trap mass spectrometer.," J. Mass Spectrom., (38) p. 138-150, (Jan. 9, 2003).

Huhmer, et al., "Analysis of Phosphopeptides by Linear Ion Trap Mass Spectrometry using Multistage Activation," Application Note: 30093, Thermo Electron Corporation, 4 pgs.

(Author Unknown), "The QSTAR® Elite and Mass Defect Triggered IDA (MDt™ IDA): Improved Ion Selection for Metabolism Studies", Technical Note, Applied Biosystems. 5 pgs.

Metelmann-Strupat, et al., "Accurate Mass Measurements Using the Finnigan LTQ FT," Application Note: 30045, Thermo Electron Corporation, 4 pgs.

Raftery, Mark J., "Selective detection of thiosulfate-containing peptides using tandem mass spectrometry," Rapid Commun. Mass Spectrom., (19) p. 674-682, (2005).

Zhang, et al., "Data-Dependent™ Neutral-Loss Mass Spectrometry for the Identification of Protein Phosphorylation," Application Note: 332, Thermo Electron Corporation, 8 pgs.

Malek, et al., "Electron Capture Dissociation on the Finnigan LTQ FT-Preserving Post-translational Modifications during Peptide Fragmentation," Application Note: 30081, Thermo Electron Corporation, 4 pgs.

Strupat, et al., "High-Throughput Analysis in Proteomics: Parallel Mass Detection using the Finnigan LTQ FT," Application Note: 30046, Thermo Electron Corporation, 4 pgs.

Zhang, et al., "JMS Letters," J. Mass Spectrom., (38) p. 1110-1112, (2003).

Raming, et al., "Fully Automated High Throughput Accurate Mass Determination Using FT-ICR Mass Spectrometry," Application Note: 30023, Thermo Electron Corporation, 4 pgs.

* cited by examiner

DATA-DEPENDENT ACCURATE MASS NEUTRAL LOSS ANALYSIS

FIELD OF THE INVENTION

The invention relates generally to mass spectrometry techniques for analyzing biomolecules, and more particularly to techniques for identifying phosphopeptides and other modified peptides by neutral loss analysis.

BACKGROUND OF THE INVENTION

Much attention in the proteomics and related research fields is devoted to the study of phosphorylation and other forms of post-translational modification of proteins. In such studies, mass spectrometers are commonly utilized to identify and sequence modified peptides. Data-dependent neutral loss analysis is a particularly useful technique for this purpose. In data-dependent neutral loss analysis, a survey (full MS) scan is initially performed to automatically and rapidly select one or more precursor ions of interest, for example, to select those ion species corresponding to the N most intense peaks in the MS spectrum. MS/MS analysis is then performed on the identified precursor ion(s), and the resultant spectra are analyzed to determine if any of the product ion species have masses that differ from the corresponding precursor ion mass by a specified amount (the neutral loss) which corresponds to the loss of a phosphate group or other modification. If it is determined that the mass of one or more product ion species differs from its precursor by the specified neutral loss amount, then a subsequent stage of fragmentation and analysis ($MS^3$) is performed on the product ion in order to generate additional mass spectral information that can be used to identify the site of modification.

Because data-dependent neutral loss analysis necessarily involves a relatively large number of mass analysis scans (e.g., one mass analysis cycle may involve a full MS scan and several MS/MS and $MS^3$ scans), the technique's implementation has been largely limited to ion trap mass spectrometers, which have the ability to execute the scans in rapid fashion. Typically, the ion trap mass spectrometer is configured to trigger the $MS^3$ scan on a product ion having a "nominal" neutral loss value rounded to the nearest integer value (e.g., 98 for phosphate). This approach suffers from low selectivity, however, because many molecular moieties can produce neutral losses having the same nominal neutral loss value. In this manner, many $MS^3$ scans will be performed unnecessarily, which may overburden the data system and reduce sample throughput. While it is desirable to use a more precise neutral loss value to trigger $MS^3$ to improve selectivity, such precision is generally beyond the capability of commercially-available ion traps when operated at normal scan rates.

Various references (see, e.g., Bogdanov et al., "Proteomics by FTICR Mass Spectrometry: Top Down and Bottom Up", *Mass Spectrometry Reviews*, Vol. 25, pp. 168-200 (2005)) discuss the use of mass analyzers capable of generating high-resolution, high mass accuracy mass spectral data, such as the Fourier Transform/Ion Cyclotron Resonance (FTICR) and Orbitrap analyzers, for identification and characterization of peptides and proteins. The accurate mass information produced by mass analyzers of this type facilitates the identification of known compounds and determination of elemental composition for unknowns. High resolution analysis allows isobaric compounds to be separated from one another or from chemical noise. However, the relatively slow mass spectra acquisition rates of high-resolution, high mass accuracy mass analyzers limit sample throughput and may be insufficient for execution of multiple $MS^n$ cycles on a chromatographic timescale.

SUMMARY

Roughly described, a method is provided for data-dependent neutral loss analysis that utilizes the high mass accuracy capabilities of an FTICR or similar analyzer in a hybrid mass spectrometer to improve selectivity of the analysis and reduce spurious $MS^3$ scans. According to one embodiment, an MS spectrum of sample ions is acquired in a first mass analyzer, such as an ion trap mass analyzer, to select one or more precursor ion of interest. The identified precursor ion(s) are then subjected to MS/MS analysis in the first mass analyzer. The MS/MS spectra are analyzed to identify one or more candidate product ions having masses that differ from their corresponding precursor ion by a specified nominal neutral loss value, the nominal loss value being representative of a phosphate group or similar modification.

Concurrently with the MS and MS/MS analysis in the first mass analyzer, an MS spectrum of the sample ions is acquired in the second mass analyzer, which may take the form of an FTICR analyzer, Orbitrap analyzer, or other mass analyzer capable of conducting mass analysis at high mass accuracy and resolution. For each identified candidate product ion, an MS/MS spectrum is then acquired in the second mass analyzer. The accurate mass difference between the candidate product ion and its precursor ion is determined from the MS and MS/MS spectra acquired in the second mass analyzer. The accurate mass difference is then compared with a specified accurate mass neutral loss value, which is a more precise representation of the mass of the phosphate group or other modification. In one embodiment, a subsequent MS3 analysis stage is performed only for those candidate product ions exhibiting an accurate mass difference that matches the accurate neutral loss value.

DETAILED DESCRIPTION OF EMBODIMENTS

Figure 1:
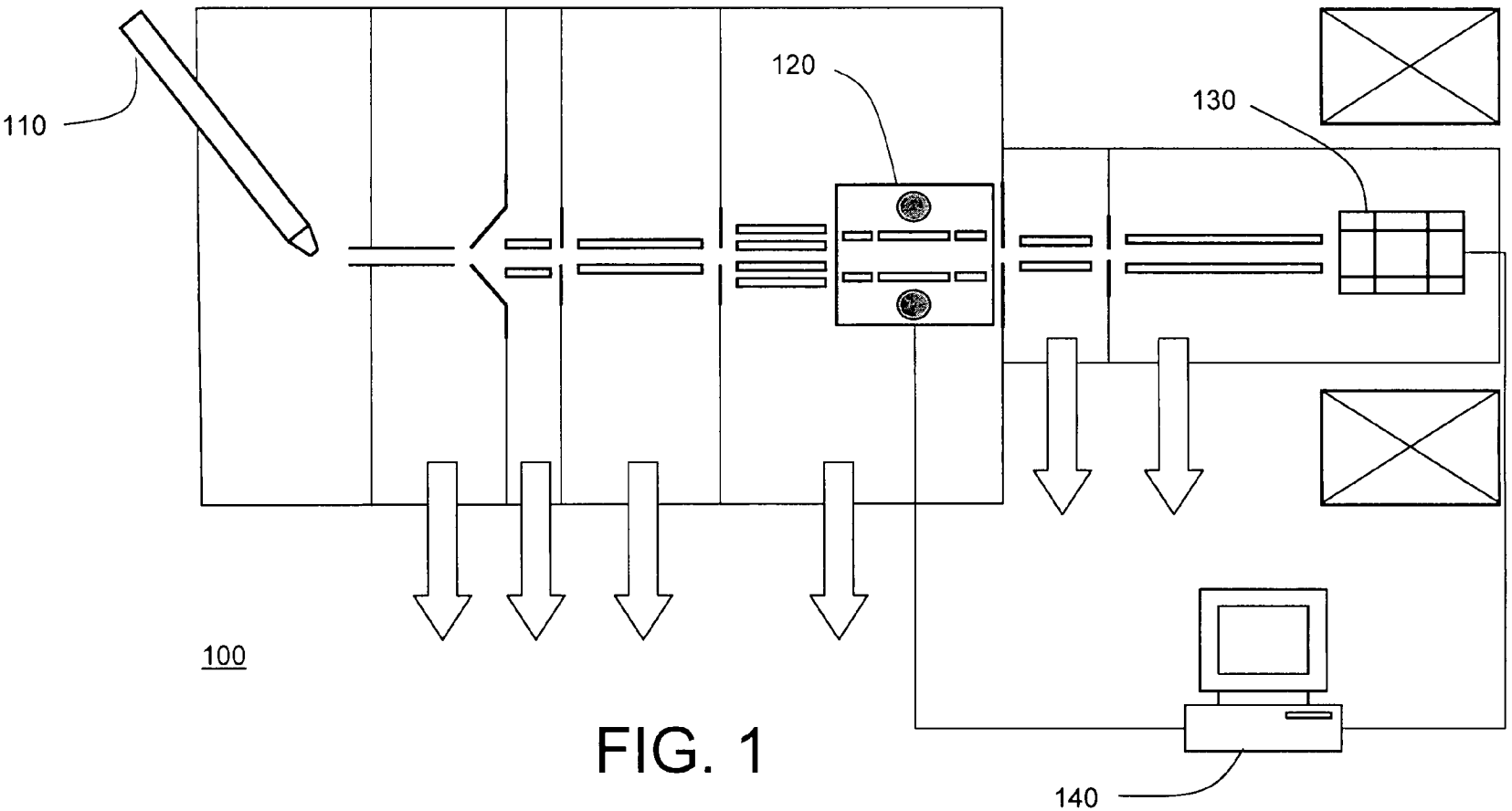
FIG. 1 is a symbolic diagram of a hybrid mass spectrometer instrument in which the methods of the present invention may be implemented.

FIG. 1 is a symbolic diagram of a commercially available hybrid linear ion trap/FTICR mass spectrometer (the LTQ FT Ultra mass spectrometer, available from Thermo Electron GmbH of Bremen, Germany) that may be utilized for implementing the data-dependent accurate mass neutral loss analysis technique of the present invention. Generally described, mass spectrometer 100 includes an ion source 110 for producing ions from a sample stream (e.g., from the eluent of a liquid chromatograph), two-dimensional quadrupole ion trap mass analyzer 120, and an FTICR mass analyzer 130. The ions are transported through a series of chambers of progressively reduced pressure by a set of ion optic components (which include electrostatic lenses, and radio-frequency RF quadrupole and octopole ion guides) that guide and focus ions to provide good transmission efficiencies. The various chambers communicate with corresponding ports (represented as arrows in the figure) of a set of pumps to maintain the pressures at the desired values. The operation of mass spectrometer 100 is controlled by control and data system 140, which also serves to process and analyze mass spectral data produced by the mass analyzers. Control and data system 140 may be implemented as any one or a combination of general or special-purpose processors, firmware, software, and hardware circuitry configured to execute a set of instructions that embody the prescribed data analysis and control routines.

It will be appreciated that the description of mass spectrometer 100 is presented by way of an illustrative example, and should not be construed to limit the invention to implementation in a particular instrument environment. In particular, any mass analyzer capable of acquiring mass spectra at high mass accuracy (typically better than 10 ppm) may be substituted for FTICR analyzer 130. Suitable alternates include an Orbitrap mass analyzer and a time-of-flight (TOF) mass analyzer.

Figure 2:
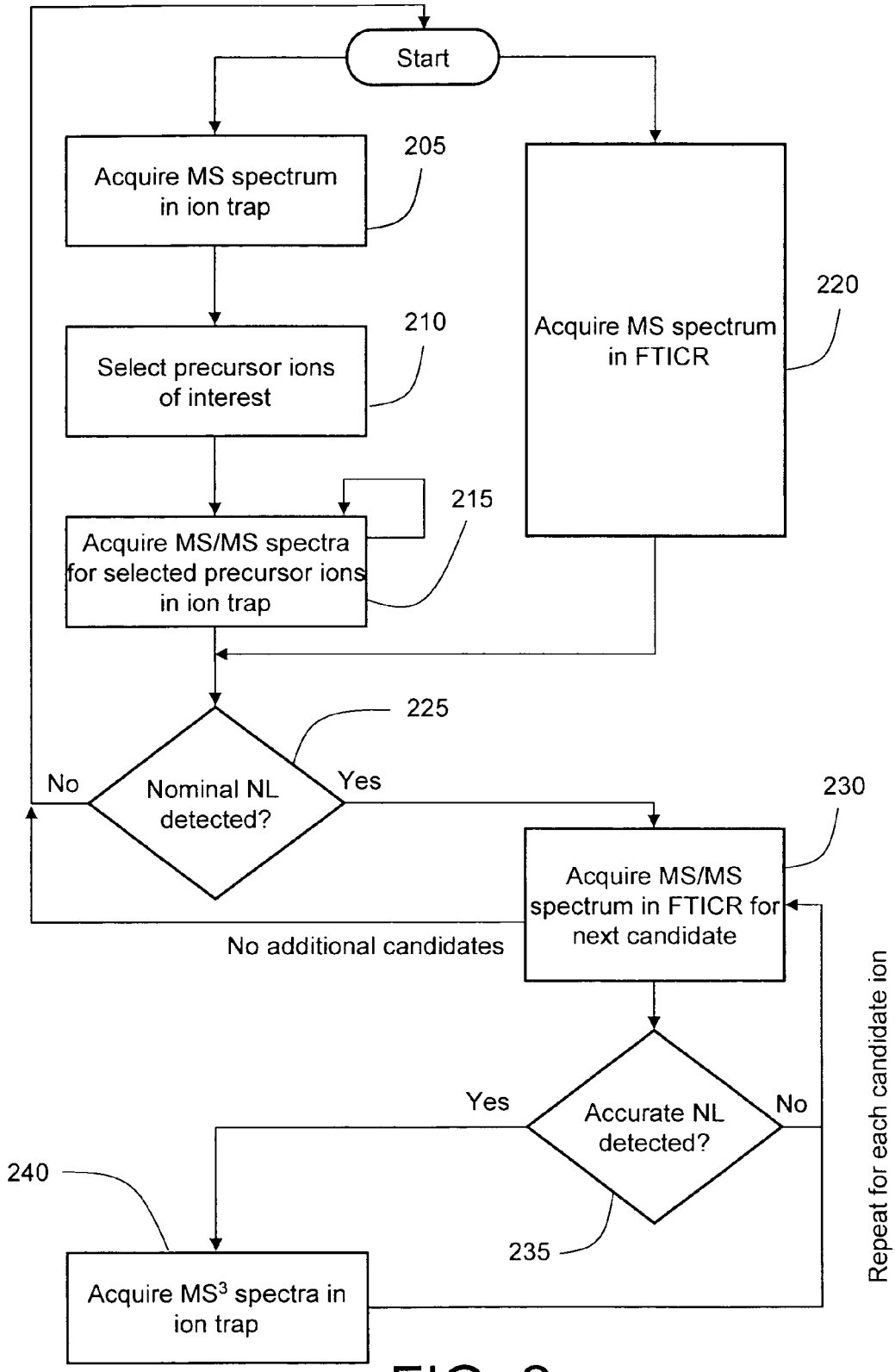
FIG. 2 is a flowchart depicting the steps of a method for data-dependent accurate mass neutral loss analysis, according to a first embodiment of the present invention whereby $MS^3$ analysis is triggered by an accurate neutral loss test.

FIG. 2 sets forth the steps of a method for performing data-dependent neutral loss analysis, in accordance with a first embodiment of the invention. Initially, in step 205, sample ions produced in ion source 110 are accumulated and kinetically cooled within ion trap mass analyzer 120 and are mass-sequentially ejected to an associated detector to generate data representative of an MS spectrum (the term "MS spectrum", as used herein and in the art, denotes a mass spectrum of sample ions acquired prior to their deliberate fragmentation; the terms "MS/MS spectrum" and "$MS^3$ spectrum" respectively denote mass spectra of product ions acquired after one and two stages of isolation and fragmentation of the sample ions). Mass-sequential ejection may be effected in ion trap 120 by the known technique of applying a resonant excitation voltage across a rod electrode pair and ramping the main trapping voltage amplitude to cause the ions to come into resonance with the excitation field in order of their mass-to-charge ratios (m/z's).

Control and data system 140 then processes the MS spectrum produced by ion trap 120 to select one or more precursor ions of interest, step 210. Precursor ion selection may be performed by applying a set of criteria, which may be operator-specified, to the mass spectrum data to identify those ions satisfying the criteria. For example, control and data system 140 may be programmed to select the N ions of greatest intensity, where N is an integer greater than or equal to one. Other criteria that may be employed to select the precursor ions include charge state, m/z inclusion or exclusion lists, and isotopic pattern matching. Selection of the precursor ions is preferably performed automatically and in real time, i.e., on a time scale that is short relative to the chromatographic peak width. It will be appreciated that the total number of precursor ions that may be selected for MS/MS analysis (and potentially $MS^3$ analysis, in accordance with the steps set forth below) will be limited based on considerations of analytical scan speed and the elution peak width or other temporal parameter characterizing the selected precursor ions are available within mass spectrometer 100 for analysis.

In an alternative implementation, the selection of precursor ions of interest may be based on the acquisition of an MS spectrum acquired by FTICR analyzer 130. In this implementation, FTICR analyzer would be operated in low-resolution (high scan speed) mode to ensure that adequate time is available for the MS/MS and $MS^3$ analyses.

Once the precursor ions are selected, MS/MS analysis of each of the selected precursor ions is carried out in ion trap analyzer 120, step 215. Techniques for isolation and fragmentation of precursor ions in two-dimensional ion traps are well known in the art and need not be described herein in detail. In a typical mode of operation, isolation is effected by application of a broadband waveform to the trap electrodes, the waveform having a narrow frequency notch centered about the secular frequency of the selected precursor ion, such that all ions except the selected precursor ion are resonantly excited and consequently removed from the ion trap. Fragmentation of the isolated precursor ion may be accomplished by conventional collision activated dissociation (CAD), pulsed-Q dissociation (PQD, described in U.S. Pat. No. 6,949,743 to Schwartz), electron transfer dissociation (ETD), or any other suitable technique. Following isolation and fragmentation of the precursor ions, an analytical scan is performed to generate an MS/MS spectrum of the resultant product ions.

Concurrently with steps 205-215, a high mass accuracy, high resolution MS spectrum of sample ions is acquired at FTICR analyzer, step 220. The MS spectrum is preferably obtained at a high resolution setting (e.g., 100,000) to ensure that precursor ion masses are assigned at very high mass accuracy for the purpose of calculating the accurate mass difference in step 235. The acquisition time for a high-resolution MS spectrum in FTICR analyzer 130 is significantly longer relative to the acquisition time (at standard resolution) of ion trap analyzer 120, such that an MS and multiple MS/MS spectra may be acquired by ion trap analyzer 120 while FTICR analyzer 130 is acquiring the high-resolution MS spectrum.

Next, in step 225, the MS/MS spectra are analyzed by control and data system 140 to identify candidate product ions. This is done by determining the nominal (integer) mass difference between the mass of each product ion represented in an MS/MS spectrum (or those product ions meeting certain additional criteria, such as having intensities exceeding a minimum value) and the corresponding precursor ion. The nominal mass difference may be assigned an integer value by rounding the calculated difference to the nearest integer, e.g., a calculated difference of 67.122 would be assigned a nominal mass difference of 67. The nominal mass differences derived from each of the MS/MS spectra are reviewed to identify any candidate product ions that have a nominal mass difference equal to a specified nominal neutral loss value. For identification of modified proteins or peptides, the specified nominal neutral loss value represents the nominal mass of the modification (e.g., 98 for phosphate) of interest. More than one nominal neutral loss value may be specified by the operator to account for different charge states and/or to simultaneously search for modifications of different types (e.g., phosphorylation, glycosylation, alkylation, or sulfation). A list of all candidate product ions satisfying the nominal neutral loss criterion (and optionally other criteria such as minimum intensity) is stored by control and data system 140. If none of the product ions in the MS/MS spectra satisfy the nominal neutral loss criterion, then the method returns to steps 205 and 220 for acquisition of MS spectra of sample ions at the ion trap and FTICR mass analyzers.

If one or more candidate product ions are identified in step 225, the mass difference between each candidate product ion and its corresponding precursor is determined with higher mass accuracy using MS/MS analysis at the second mass analyzer, and this accurate mass difference is compared to an accurate mass neutral loss value in order to confirm whether the mass of the candidate product ion does in fact represent the loss of a phosphate group or other modification of interest. In step 230, an MS/MS spectrum is acquired at FTICR analyzer 130 for the precursor ion corresponding to a candidate product ion selected from the list of candidate product ions developed in step 225. Isolation and fragmentation of the precursor ion is effected within ion trap analyzer 120 (to ensure equivalent fragmentation patterns), and the resultant product ions are transported to FTICR analyzer 130 for MS/MS spectrum acquisition. The MS/MS spectra may be acquired at reduced resolution (e.g., 10,000) relative to the MS spectrum to ensure that multiple MS″ cycles may be completed across the chromatographic peak.

In step 235, the mass of the selected candidate product ion is assigned using the data from the MS/MS spectrum acquired in step 230, and an accurate mass difference between the candidate product ion and its precursor is calculated by subtracting the candidate product ion mass from the corresponding precursor ion mass, which is assigned using the data from the FTICR MS spectrum acquired in step 220. In contrast to the nominal mass difference calculation of step 225, the accurate mass difference is a precise value (to, for example, three decimal points) calculated from accurate mass assignments. Control and data system 140 then determines if the accurate mass difference matches (e.g., is within a defined tolerance of) a specified accurate mass neutral loss value. The accurate mass neutral loss value is a more precise representation (relative to the nominal neutral loss) of the modification of interest, e.g., 97.977 for a phosphate group.

If it is determined in step 235 that the selected candidate production does not satisfy the accurate mass neutral loss test, then the method returns to step 230 for acquisition of an MS/MS spectrum of the next candidate product ion from the list of candidate product ions (or, if MS/MS analyses have been conducted at FTICR analyzer 130 for all candidate ions, the method returns to steps 205 and 220 for acquisition of MS spectra.) However, if the selected candidate product does exhibit an accurate mass difference matching the specified accurate mass neutral loss value (indicating a high level of confidence that the candidate product ion has been formed via loss of a phosphate group or other modification), then the candidate product ion is subjected to $MS^3$ analysis (step 240) in order to generate mass spectral data useful for protein/peptide identification and characterization. Isolation and fragmentation of the candidate product ion may be carried out in ion trap 120 using known techniques, and mass analysis of the resultant second-generation product ions may be performed either in ion trap 120 or (if high resolution, accurate mass $MS^3$ spectra are desirable) in FTICR analyzer 130. In other implementations of the method, fragmentation of the candidate product ion is performed in a fragmentation device (e.g., a collision cell) external to the mass analyzers. After the $MS^3$ spectrum has been acquired, the method returns to step 230 for acquisition of an MS/MS spectrum of the next candidate product ion from the list of candidate product ions or, if MS/MS analyses have been conducted at FTICR analyzer 130 for all candidate ions, to steps 205 and 220 for acquisition of MS spectra.

The method of FIG. 2 provides for more efficient analyses of proteins and peptides by limiting $MS^3$ analysis to those ions which can be identified with a high degree of confidence as having the modification of interest. In this manner, $MS^3$ analysis of interfering species (those that meet the nominal neutral loss test but do not have the desired modification) and the associated acquisition time and computational costs are avoided, leaving more acquisition cycles and available resources to obtain potentially meaningful mass spectral data.

Figure 3:
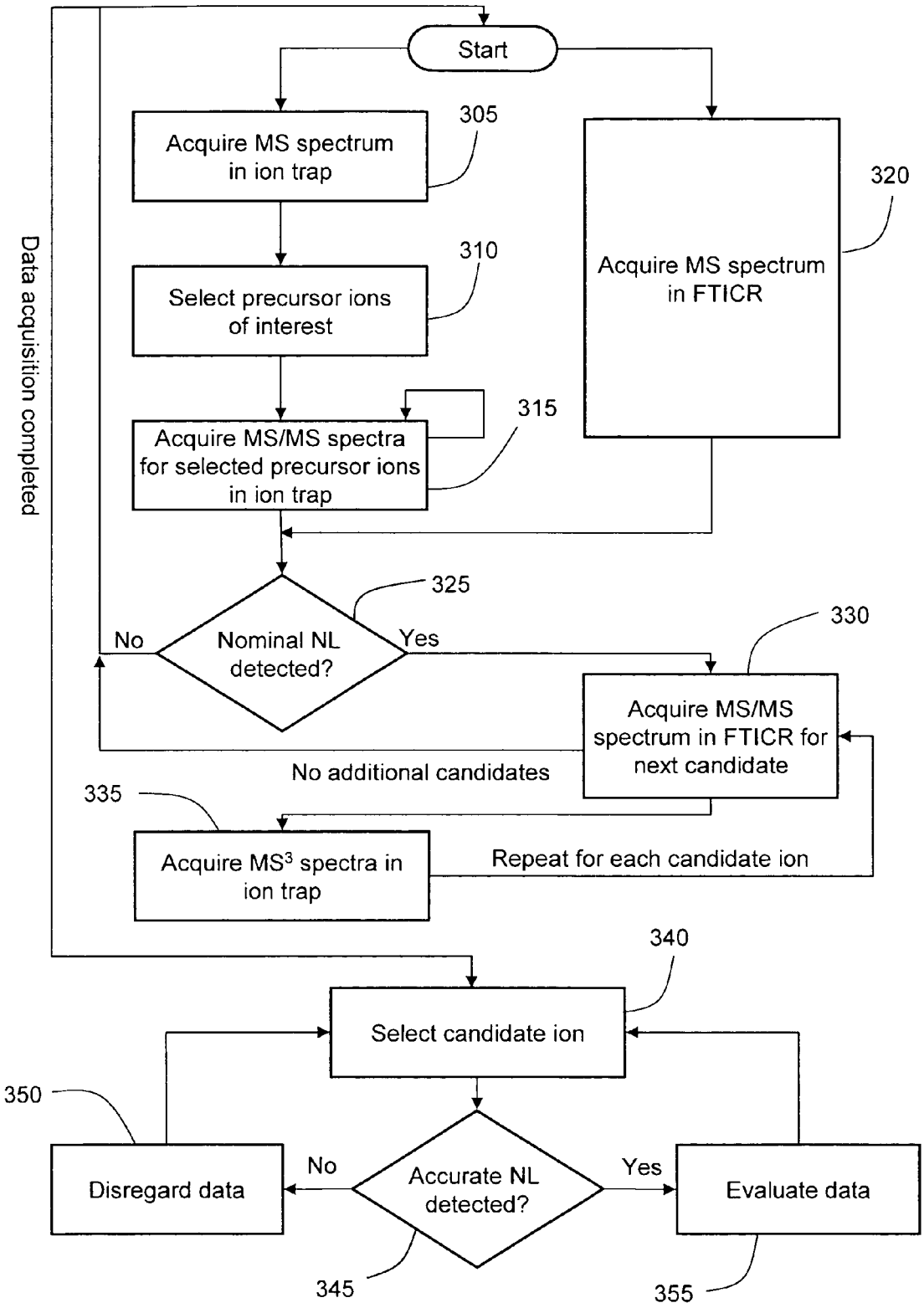
FIG. 3 is a flowchart depicting a data-dependent accurate mass neutral loss analysis method according to a second embodiment, whereby the accurate neutral loss test is employed to determine whether to discard data from $MS^3$ analyses.

FIG. 3 sets forth the steps of a method for performing neutral-loss analysis of sample ions in a hybrid mass spectrometer, according to a second embodiment of the invention. In this embodiment, confirmation of the mass difference between the candidate product ion and its precursor is performed as a post-acquisition process, rather than in real time. Steps 305, 310, 315, 320, 325 and 330, involving the acquisition of MS spectra and selection of precursor ions, MS/MS analysis of the selected precursor ions, concurrent acquisition of accurate mass, high-resolution MS spectra, identification of candidate product ions, and acquisition of accurate mass MS/MS spectra for the candidate product ions, proceed in a manner substantially identical to corresponding steps 205-230 of the first embodiment. However, rather than performing $MS^3$ analysis in a data-dependent manner (i.e., only on those candidate product ions that satisfy the accurate mass difference test), per steps 235 and 240 of the first embodiment, $MS^3$ spectra are acquired for all of the candidate product ions, as indicated by the loop defined by steps 330 and 335. After all mass spectral data has been acquired, control and data system 140 executes a post-acquisition data filtering routine depicted in steps 340-355. For each candidate product ion identified during data acquisition, an accurate mass difference test is applied in a manner similar to that described above in connection with step 235. An accurate mass difference is calculated for the selected candidate product ion based on data derived from the associated MS and MS/MS spectra acquired by FTICR analyzer 130. If the calculated accurate mass difference matches (e.g., is within a defined tolerance of) a specified accurate mass neutral loss value, then the mass spectral data for the candidate product ion is retained for further processing; if not, then the mass spectral data is disregarded.

Those skilled in the art will recognize that the foregoing methods are not limited to identification of modified peptides or proteins, but instead may be advantageously applied to improve specificity in any data-dependent neutral loss experiment. For example, the methods may be employed to identify drug metabolites in metabolism studies by specifying nominal and accurate mass neutral loss values corresponding to one or more biotransformations of interest.

It is to be more generally understood that while the invention has been described in conjunction with the detailed description thereof, the foregoing description is intended to illustrate and not limit the scope of the invention, which is defined by the scope of the appended claims. Other aspects, advantages, and modifications are within the scope of the following claims.

What is claimed is:

1. A method of performing neutral-loss analysis of sample ions in a hybrid mass spectrometer having a first mass analyzer and a second mass analyzer, the second mass analyzer being capable of acquiring mass spectra at high resolution and mass accuracy, the method comprising steps of:

(a) acquiring an MS spectrum of the sample ions to identify at least one precursor ion of interest;

(b) fragmenting the at least one precursor ion of interest to yield product ions, and acquiring an MS/MS spectrum of the product ions at the first mass analyzer;

(c) identifying at least one candidate product ion having a mass that differs from the corresponding precursor ion species by a nominal neutral loss value;

(d) acquiring a mass spectrum of the sample ions at the second mass analyzer;

(e) acquiring an MS/MS spectrum at the second mass analyzer of product ions produced by fragmenting the precursor ion corresponding to the at least one candidate product ion species, and determining, based on the MS and MS/MS spectra obtained at the second analyzer, whether the accurate mass difference between the at least one candidate product ion species and the corresponding precursor ion species matches an accurate neutral loss value; and (f) acquiring or processing an $MS^3$ spectrum of the at least one candidate product ion in dependence on the determination performed in step (e).

2. The method of claim 1, wherein step (d) is performed concurrently with steps (a) and (b).

3. The method of claim 1, wherein step (f) includes performing $MS^3$ analysis of the at least one candidate product ion only if the accurate mass difference matches the accurate neutral loss value.

4. The method of claim 1, wherein step (f) includes:

disregarding $MS^3$ analysis data if the accurate mass difference does not match the accurate mass neutral loss value.

5. The method of claim 1, wherein the at least one precursor ion species of interest correspond to the N most abundant ion species, where N is an integer equal to or greater than one.

6. The method of claim 1, wherein the sample ions include peptide or protein ions, and the nominal and accurate neutral loss values correspond to a loss of a post-translational modification.

7. The method of claim 5, wherein the modification is a phosphate group.

8. The method of claim 1, wherein the first mass analyzer is an ion trap.

9. The method of claim 1, wherein the second mass analyzer is an FTICR analyzer.

10. The method of claim 1, wherein the second mass analyzer is an Orbitrap analyzer.

11. The method of claim 1, wherein the second mass analyzer performs step (e) in a reduced-resolution mode.

12. The method of claim 1, wherein step (a) is performed by the first mass analyzer.

13. The method of claim 1, wherein step (a) is performed by the second mass analyzer operating in a reduced-resolution mode.

* * * * *